US011053899B2

(12) United States Patent
Meek et al.

(10) Patent No.: US 11,053,899 B2
(45) Date of Patent: Jul. 6, 2021

(54) POSITIONING FEATURE OF A STATOR ASSEMBLY OF A FUEL INJECTOR

(71) Applicant: DELPHI TECHNOLOGIES IP LIMITED, St. Michael (BB)

(72) Inventors: George A. Meek, Aylburton (GB); Thomas Hagon, Quedgeley (GB)

(73) Assignee: DELPHI TECHNOLOGIES IP LIMITED

( * ) Notice: Subject to any disclaimer, the term of this patent is extended or adjusted under 35 U.S.C. 154(b) by 20 days.

(21) Appl. No.: 16/344,570

(22) PCT Filed: Oct. 19, 2017

(86) PCT No.: PCT/EP2017/076738
§ 371 (c)(1),
(2) Date: Apr. 24, 2019

(87) PCT Pub. No.: WO2018/077721
PCT Pub. Date: May 3, 2018

(65) Prior Publication Data

US 2020/0018275 A1 Jan. 16, 2020

(30) Foreign Application Priority Data

Oct. 24, 2016 (GB) ..... 1617942

(51) Int. Cl.

| | |
|---|---|
| ***F02M 55/02*** | (2006.01) |
| ***F02M 51/00*** | (2006.01) |
| ***F02M 51/06*** | (2006.01) |
| ***F02M 61/16*** | (2006.01) |
| ***H01R 13/64*** | (2006.01) |

(52) U.S. Cl.
CPC ..... *F02M 51/005* (2013.01); *F02M 51/0614* (2013.01); *F02M 61/168* (2013.01); *H01R 13/64* (2013.01)

(58) Field of Classification Search
CPC ..... F02M 55/005; F02M 61/14; F02M 61/10; F02M 2200/853; F02M 2200/856
USPC ..... 123/468, 469, 470
See application file for complete search history.

(56) References Cited

U.S. PATENT DOCUMENTS

| | | | | |
|---|---|---|---|---|
| 5,129,834 | A | 7/1992 | Cranford | |
| 6,187,242 | B1 | 2/2001 | Onoda | |
| 9,771,907 | B2 * | 9/2017 | Meek | F02M 43/04 |
| 2006/0186767 | A1 | 8/2006 | Redding et al. | |
| 2009/0206700 | A1 * | 8/2009 | Heinz | F02M 51/0603 310/328 |
| 2010/0258651 | A1 * | 10/2010 | Tekoral | F02M 51/005 239/289 |
| 2010/0300408 | A1 | 12/2010 | Aronhalt et al. | |
| 2013/0186986 | A1 | 7/2013 | Wolff et al. | |
| 2015/0369176 | A1 * | 12/2015 | Ittlinger | F02M 37/48 239/575 |

(Continued)

FOREIGN PATENT DOCUMENTS

DE 3220090 A1 12/1983

*Primary Examiner* — John Kwon
(74) *Attorney, Agent, or Firm* — Joshua M. Haines

(57) ABSTRACT

A positioning feature includes a first member so that in an embodiment where the pins of a connector are perpendicular to a main axis, an incorrect angular orientation is prevented by the positioning feature that would contact one of the pins and, a correct angular orientation is assured by the engagement of the first member between the pins.

15 Claims, 4 Drawing Sheets

(56) References Cited

U.S. PATENT DOCUMENTS

| | | | | |
|---|---|---|---|---|
| 2016/0169172 | A1* | 6/2016 | Meek | F02M 51/005<br>123/472 |
| 2018/0080916 | A1* | 3/2018 | Sanet | G01N 27/07 |

* cited by examiner

POSITIONING FEATURE OF A STATOR ASSEMBLY OF A FUEL INJECTOR

CROSS REFERENCE TO RELATED APPLICATIONS

This application is a national stage application under 35 USC 371 of PCT Application No. PCT/EP2017/076738 having an international filing date of Oct. 19, 2017, which is designated in the United States and which claimed the benefit of GB Patent Application No. 1617942.6 filed on Oct. 24, 2016, the entire disclosures of each are hereby incorporated by reference in their entirety.

TECHNICAL FIELD

The present invention relates to a fuel injector and more particularly to a positioning feature arranged at an end of electrical leads ensuring during the assembly process correct electric connection.

BACKGROUND OF THE INVENTION

A stator assembly of a fuel injector comprises a first cylindrical body and a second cylindrical body integrally overmoulded. A solenoid is arranged in the first body and electrical leads extending toward a distant end provided with electrical terminals are in the second body. Said terminals are adapted to electrically connect to the pins of a connector and, in the assembly process a correct electrical connection at the end is only assured by a correct angular position of the stator assembly at the beginning, when said stator assembly is inserted in a complementary bore provided in a body member of the fuel injector.

SUMMARY OF THE INVENTION

Accordingly, it is an object of the present invention to resolve the above mentioned problems. A first aspect of the invention is a positioning feature adapted to be arranged at the extremity of electrical leads of a stator assembly of a fuel injector, said extremity being provided with two terminals, adapted to engage about an main axis in electrical contact with two pins, of a connector, the positioning feature preventing incorrect positioning of the terminals relative to the pins.

Furthermore, the positioning feature comprises a first member having a transverse front face which length is smaller than the inter-pins distance so that, in an embodiment where said pins extend substantially perpendicular to the main axis, during the engagement process an incorrect angular orientation of the stator assembly is prevented by a preliminary contact between the front face and one of the pins and, a correct angular orientation is assured by the engagement of the first member between the pins.

Also, said first member further defines two axially extending lateral faces, each joining one end of the front face so that, a finer adjustment of the angular orientation of the stator assembly is provided by said lateral faces, contacting the pins and therefore preventing further rotation of the stator assembly.

In a second aspect, the invention, provides to a positioning feature adapted to be arranged at the extremity of electrical leads of a stator assembly of a fuel injector, said extremity being provided with two terminals, adapted to engage about a main axis in electrical contact with two pins, of a connector, the positioning feature preventing incorrect positioning of the terminals relative to the pins, wherein the positioning feature comprises a second member arranged around the leads and defining side axial faces so that, in an embodiment where the pins extend aligned with the main axis, a correct angular orientation of the stator assembly is assured by the engagement of each pin next to a side face.

Said second aspect of the invention falls under the exact same inventive concept as the first aspect, both aspects aiming at a correct electrical connection and differing only by the orientation of the connector relative to the leads.

In said second aspect, the second member defines two notches, in which engage the pins when being correctly oriented, the side faces being faces of the notches.

In a third aspect of the invention, both first and second aspects are combined, the positioning feature comprising both a first member and also a second member.

Also, the first and second members are integrally moulded together.

The invention further extends to a stator assembly of a fuel injector, said stator assembly comprising a solenoid and electrical leads overmoulded so that a thin cylindrical body is formed, from an end of which extend the electrical leads provided at their extremity with electrical terminals.

The stator assembly further comprises a positioning feature as previously described and arranged beside the terminals.

Also, in another aspect, the positioning feature is integrally moulded with the stator assembly.

Also, the terminals, are sprung blades adapted to resiliently deflect when being forced in contact against the cylindrical pins, of the connector, an accidental contact between said sprung terminals being prevented by an isolating partition wall overmoulded between the sprung terminals, said wall being integral to the thin cylindrical body.

Also, the first member of the positioning feature is perpendicular to said partition wall.

The invention further extends to a fuel injector having a body provided with a bore and an electrical connector provided with two cylindrical pins, extending in said bore, and wherein the fuel injector is further provided with a stator assembly arranged in said bore, the stator assembly being as previously described, the terminals of the stator assembly being in electrical contact with the pins, of the connector.

BRIEF DESCRIPTION OF THE DRAWINGS

The present invention is now described by way of example with reference to the accompanying drawings in which.

DESCRIPTION OF THE PREFERRED EMBODIMENTS

A fuel injector 10 not represented, delivers in use, pressurised fuel via holes provided in a nozzle protruding in a piston of an internal combustion engine. A valve member also often identified as a needle is arranged in the body 12 of the injector 10 and is adapted to alternatively close and open said holes. In an hydraulically piloted injector, such as a diesel fuel injectors, a control valve 14 hydraulically commands the displacements of said needle by enabling fuel pressure to rise or to drop within a control chamber. Said control valve 14 comprises a stator assembly 16 fixed in the body 12 and adapted to cooperate with a movable armature-and-stem assembly, not represented.

Figure 1:
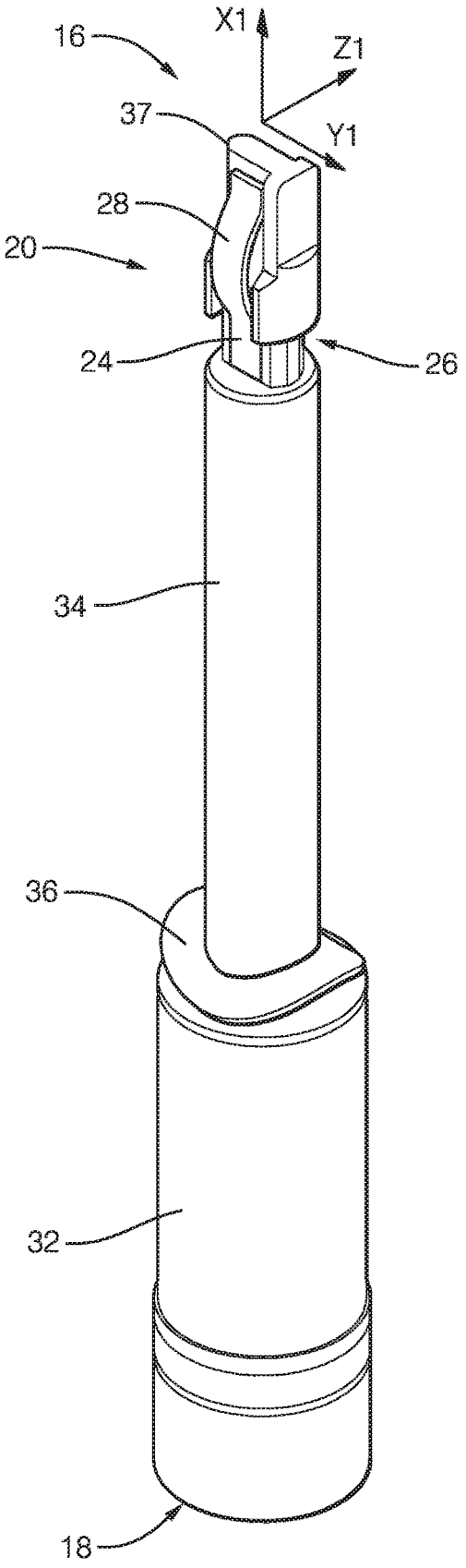
FIG. 1 is an isometric view of a stator assembly as per the invention.
Figure 2:
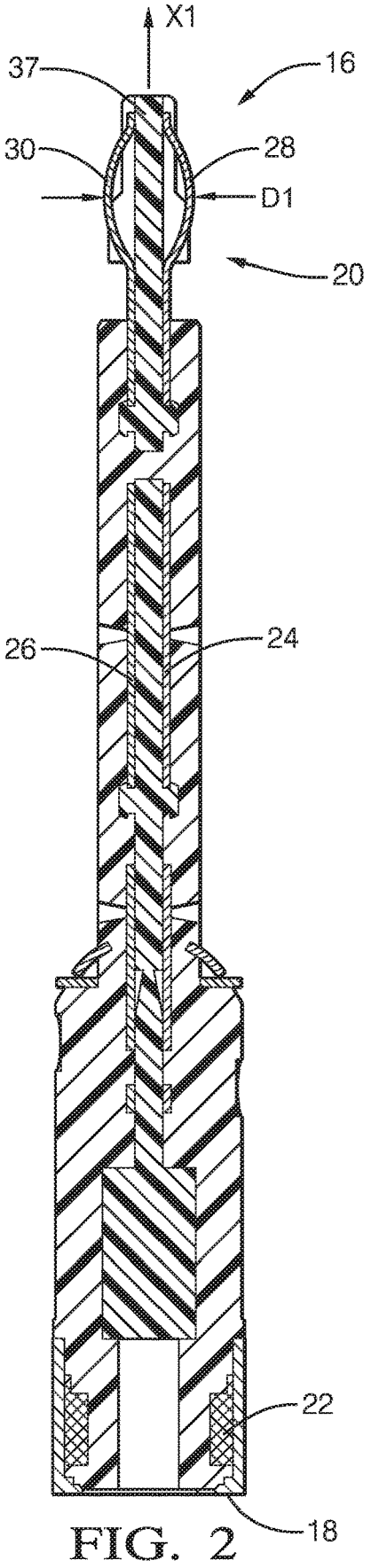
FIG. 2 is an axial section of the stator assembly of FIG. 1.

In reference to FIGS. 1 and 2, the stator assembly 16 has an elongated shape extending along a main axis X1 between a bottom flat face 18 transverse to the axis X1 to a head end 20 where is arranged the invention of the present disclosure. The stator assembly 16 used as an illustration to the disclosure comprises an annular solenoid 22 wound around a core and arranged in the vicinity to the bottom face 18, two electrical leads 24, 26 upwardly extending from the solenoid 22 toward the head end 20 where each of the leads 24, 26 is provided with a blade terminal 28, 30 that is a sprung terminal having a curved shape forming a leaf spring that can be compresses in a transverse direction to the main axis X1 for enabling resilient deflexions of the blades. The solenoid, core and leads are integrally overmoulded forming a large cylindrical body 32 upwardly extending from the bottom face 18 to a transverse shoulder face 36 and, a thin cylindrical body 34 upwardly extending from said shoulder face 36 to the head end 20. In the large body 32 are overmoulded the solenoid, the core and the connections to the electrical leads and, in the thin body 34 are overmoulded the two leads 24, 26. The terminals 28, 30 protrude at the top of said thin body 34. Also, as visible in FIGS. 7, 8, 9, a flat partition wall 37 is integrally overmoulded with the thin body 34 and it extends between the blade terminals 28, 30 that are symmetrically arranged on each side of said partition wall 37. The leads protrude from the end of the thin body 34 already under the form of flat blades following a face of the wall 37. A spring is formed at the very end of each blade by forming a curved portion lifting away from the wall 37 then coming back to the wall, the end of each blade being able to slide against said face of the wall 37. Before assembly, when not being compressed, the curved portions are distant from each other by an inter-terminals distance D1 and, the wall 37 enables resilient deflexion and flattening of the curved portion while preventing any electrical short between the terminals. Also, the two bodies 32, 34 are concentrically formed, both extending about the main axis X1 although, in other embodiments the two bodies may extend about two axes offset from each other.

Figure 3:
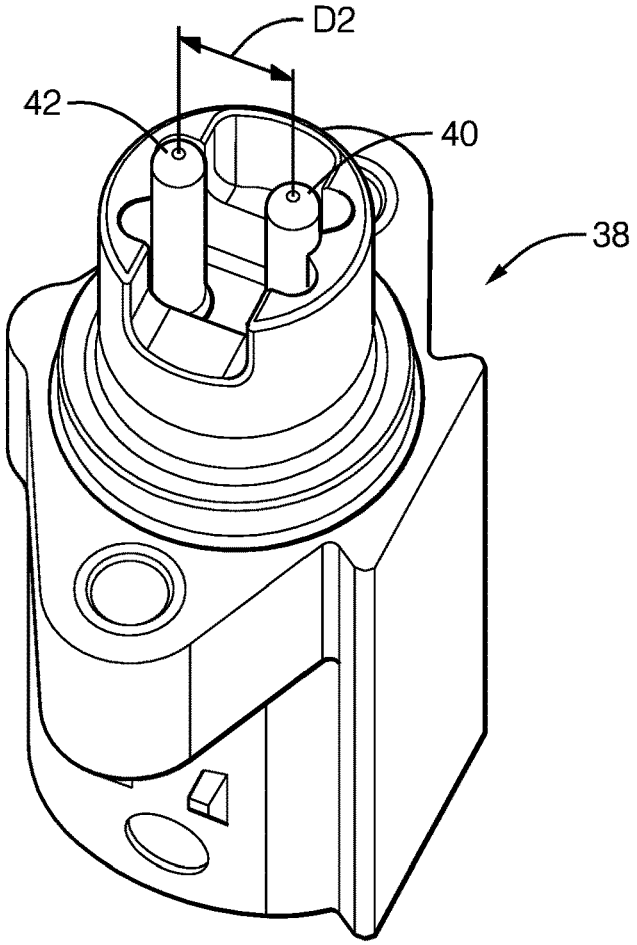
FIG. 3 is an isometric view of a connector of a fuel injector.

At the very top of the fuel injector is arranged an electrical connector 38, represented in FIG. 3, provided with two electrical pins 40, 42 adapted to electrically connect to the two blade terminals 28, 30. The pins 40, 42 are parallel cylindrical members extending about a connector axis X2, the pins 40, 42 being distant from each other by an inter-pin distance D2 that is smaller than the inter-terminals distance D1. In a first embodiment represented on FIG. 4, said the connector axis X2 is perpendicular to the main axis X1, the injector 10 having a side orientation of the connector and, in a second embodiment represented on FIG. 5, the connector axis X2 is aligned with said main axis X1, the injector 10 having a top orientation of the connector.

During the assembly process, the connector 38 is arranged at the top of the injector body 12, the two pins 40, 42 extending above the opening of a bore provided in said body and then, the stator assembly 16 is upwardly inserted in said bore, the thin body 34 with the terminals 28, 30 and the head end 20 engaging first and being inwardly pushed by the large body 32. When the insertion is almost complete the terminals 28, 30 come in contact with the pins 40, 42 then, further upward displacement of the stator assembly 16 forces the blade terminals 28, 30 to engage between the pins 40, 42 to resiliently deflect and flatten against the partition wall 37 exerting contact forces ensuring electrical contact between said pins and said terminals, thus finally enabling electrical connection from a command unit complementary plugged in said connector 38 to the solenoid.

Figure 4:
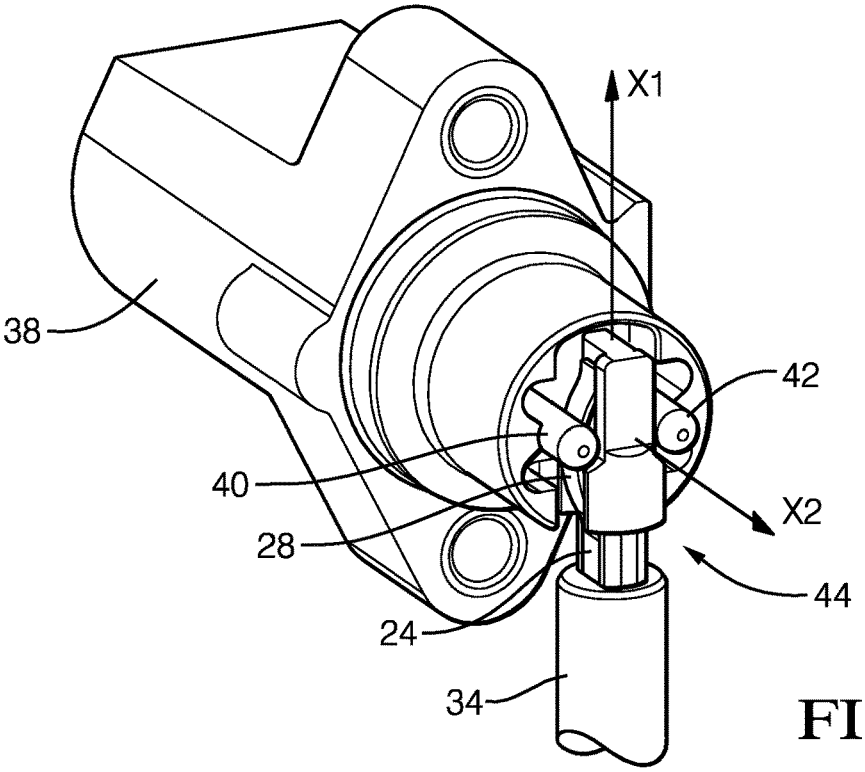
FIG. 4 is an isometric detailed view of an first embodiment wherein are arranged the stator assembly and the connector.
Figure 5:
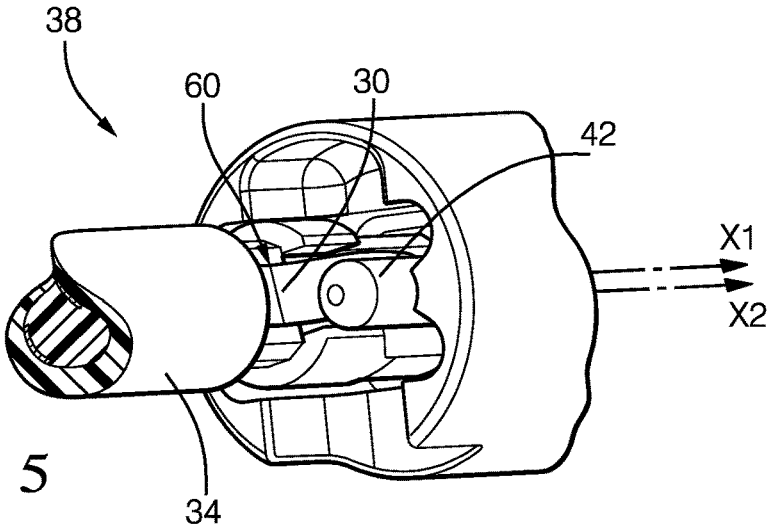
FIG. 5 is an isometric detailed view of a second embodiment wherein are arranged the stator assembly and the connector.

In the first embodiment of FIG. 4, the head end 20 perpendicularly engages between the pins 40, 42 and, in the secondary embodiment of FIG. 5, the head end 20 is axially aligned with said pins, still engaging between them.

Figure 9:
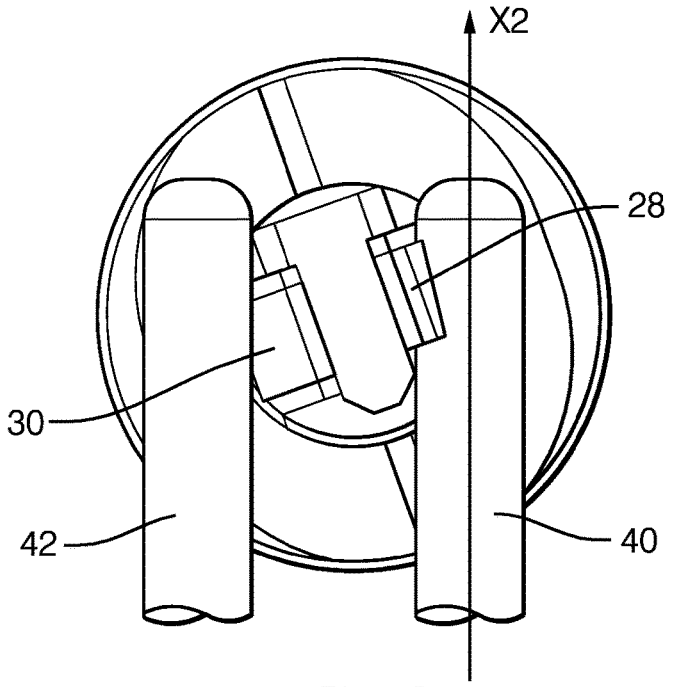
FIGS. 9 and 10 are two misalignment example of the stator assembly relative to the connector.
Figure 10:
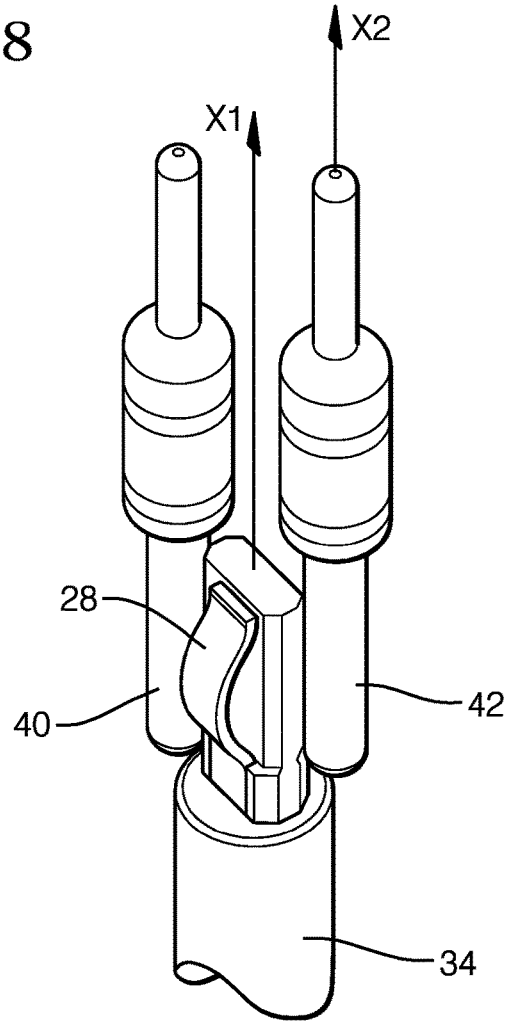

To avoid incorrect positioning of the terminals and the pins, leading to poor and defective electrical contacts, as shown on FIG. 9 for the first embodiment, and on FIG. 10 for the second embodiment, the stator assembly 16 is further provided with a positioning feature 44, also known worldwide by the Japanese name "poka-yoke", arranged in the head end 20 beside the terminals 28, 30.

In the exemplary embodiment represented, said positioning feature 44 is integrally moulded with the stator assembly 16. In alternative embodiments, said alignment feature can be a separate feature arranged on the stator assembly.

Figure 6:
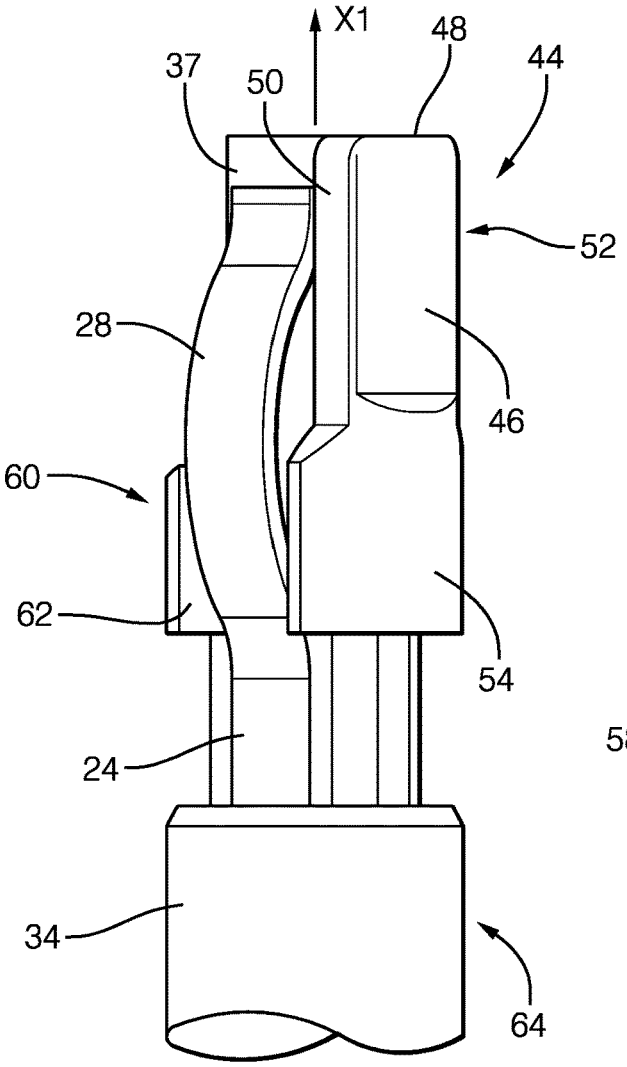
FIGS. 6 and 7 are isometric detailed views of an end of the stator assembly of FIGS. 1 and 2 presenting an alignment feature as per the invention.
Figure 7:
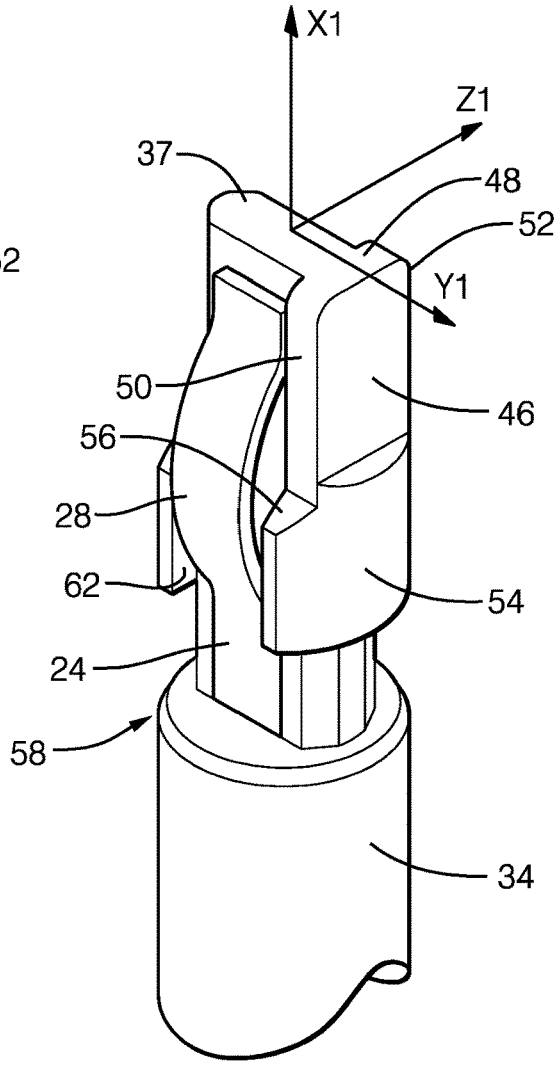
Figure 8:
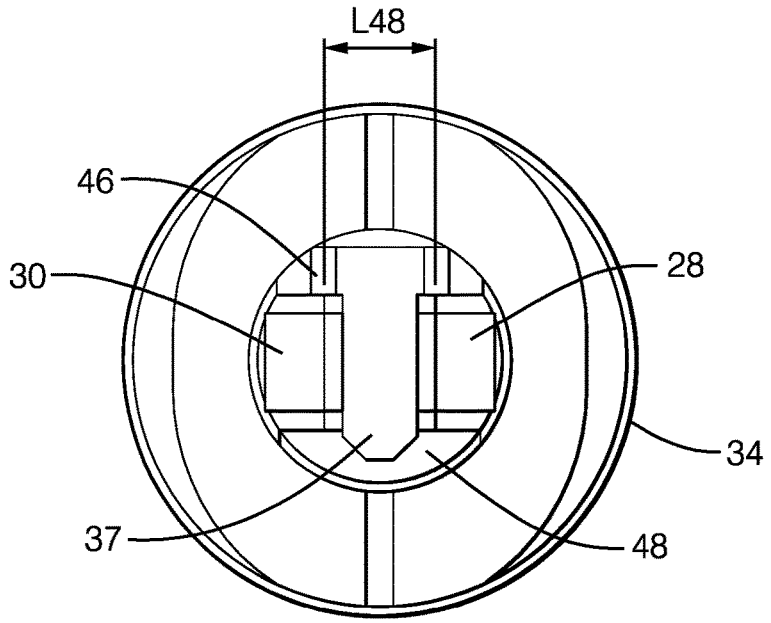
FIG. 8 is a top view of the stator assembly of the previous figures.

More in details, the alignment feature 44 represented in FIGS. 6 and 7 in a tri-axes referential system comprising the main axis X1, a perpendicular second axis Y1 extending along the partition wall between the blade terminals and, a transverse third axis Z1 perpendicular to both other axes X1, Y1 comprises a first member 46, particularly used for the perpendicular assembly of the first embodiment of FIG. 4 and, a second member 54 used for the aligned assembly of the second embodiment of FIG. 5.

The first member 46 is a planar member laterally extensions on both sides of an end the partition wall 37. Said first member 46 defines a peripheral rectangular top face 48 with main length L48 extending along the transverse axis Z1, from the distant edges of which downwardly extend along the main axis X1, two rectangular opposed lateral faces 50, 52 mainly extending along the main axis X1. The length L48 of the front face is just smaller than the inter-pin distance D2 and, as visible on the top view of FIG. 8, the partition wall 37 and the first member 46 have together a "T" cross-section where the vertical leg of the T is the partition wall 37 and the horizontal upper bar of the T is said first member 46 of the positioning feature 44.

FIG. 4 represents a correct positioning of the stator assembly 16, the first member 46 being entirely engaged between the pins 40, 42 and being substantially perpendicular to the connector axis X2. Incorrect positioning, as shown in FIG. 9, is prevented by the first member 46 since if not correctly oriented when approaching the end of the upward insertion of the stator assembly 16, the front face 48 would first hit the pins 40, 42 and would stop further engagement forbidding the final insertion of the terminals 28, 30 between the pins 40, 42. Moreover, when the upward insertion is completed as shown on FIG. 4, angular rotation of the stator assembly 16 about the main axis X1 is also prevented by the lateral faces 50, 52 that would first hit the pins. Therefore, the first member 46 ensures a good electrical connection of the terminals and the pins in the case of a perpendicular embodiment as shown in FIG. 4.

In an alternative embodiment not show, the alignment feature could be provided with a second first member arranged at the opposite end of the partition wall, changing the cross-section from a T to a symmetrical shape with upper and lower horizontal bars.

The alignment feature 44 further comprises the second member 54, particularly used for the aligned assembly of the second embodiment of FIG. 5, said second member 54 being arranged right below the first member 44 and being integrally moulded as well. The second member 54 and the first member 44 join together via a plurality of shoulder faces 56, represented flat or bevelled on the figures. The second member 54 is an upward extension of the thin cylindrical body 34 further provided with two diametrically opposed notches 58, 60, defining opposed side walls 62 between which the blade terminal 28, 30 upwardly extends and allow for the curved portion to lift from the partition wall 37. Also, in the embodiment represented, said second member 54 is distant from the top end of the thin body 34, wherefrom upwardly extend the partition wall 37 and the blade terminals 28, 30 thus, defining an annular groove 64 surrounding said partition wall 37 and the two blades.

The second member 54 being arranged below the first member 46 does not interfere, and plays no role in the perpendicular first embodiment of FIG. 4, said second member 54 remaining below the pins and not contacting them.

As it is shown in the aligned second embodiment of FIG. 5, the second member 54 prevents from incorrect angular orientation of the stator assembly 16 as shown in FIG. 10, by guiding the pins into the notches 58, 60 or, more precisely, by engaging the notches around the pins. If not correctly oriented when approaching the end of the upward insertion during assembly of the stator assembly 16, the shoulder faces 56 would first hit the extremity of the pins 40, 42 and would stop further the insertion. Moreover, when the upward insertion is completed as shown on FIG. 5, the pins 40, 42 are engaged in the notches 58, 60 between the side faces 62. An angular rotation of the stator assembly 16 about the main axis X1 is then prevented by said side faces 62 that would first hit the pins. Therefore, the second member 54 ensures a good electrical connection of the terminals and the pins in the case of a aligned embodiment.

In the embodiment represented, the positioning feature comprises only one first member 46 and, the second member 54 comprises two opposed halves, one of them being moulded below the first member 46, the other being moulded on the other side of the partition wall where there is no first member. Said second half of the second member therefore defines a semi-circular flat upward face that can be considered similarly to a joining shoulder face 56.

Furthermore, the positioning feature 44 could only comprise one first member 46 and only one half of the second member, this still accommodating both the perpendicular and the aligned arrangements.

Because of said two distinct embodiments, perpendicular engagement and aligned engagement, the described positioning feature 44 comprises two distinct members 46, 54 but, should only one embodiment having to be considered, the positioning feature 44 could only comprise only the one relevant member, either a first member 46 or a second member 54.

LIST OF REFERENCES

X1 main axis
Y1 longitudinal axis
Z1 transverse axis
X2 connector axis
D1 inter-terminal distance
D2 inter-pins distance
L48 length of the front face
10 fuel injector
12 body of the injector
14 control valve
16 stator assembly
18 bottom flat face of the stator assembly
20 head end of the stator assembly
22 solenoid
24 electrical leads
26 electrical leads
28 terminal
30 terminal
32 large cylindrical body
34 thin cylindrical body
36 shoulder face
37 partition wall
38 connector
40 pin
42 pin
44 alignment feature—poka-yoke
46 first member
48 front face of the first member
50 lateral face of the first member
52 lateral face of the first member
54 second member
56 shoulder face joining first and second members
58 notch
60 notch
62 side face of the notch
64 groove

The invention claimed is:

1. A positioning feature adapted to be arranged at an extremity of electrical leads of a stator assembly of a fuel injector, said extremity being provided with two terminals adapted to engage about a main axis in electrical contact with two pins of a connector said two pins of said connector being separated from each other by an inter-pins distance, wherein a partition wall extends between said two terminals such that said terminals are symmetrically arranged on a first side of said partition wall and a second side of said partition wall respectively, the positioning feature preventing incorrect positioning of the two terminals relative to the two pins, the positioning feature comprising:

a first member integral to the partition wall and laterally extending on said first side of said partition wall and on said second side of said partition wall, said partition wall and said first member having together a "T" cross-section where a vertical leg of the "T" is the partition wall and a horizontal bar of the "T" is the first member;

said first member having a transverse front face with a length extending perpendicular to the main axis which is smaller than the inter-pins distance of said two pins so that, during the engagement process with said connector having said two pins extending perpendicular to the main axis, an incorrect angular orientation of the stator assembly is prevented by a preliminary contact between the front face and one of the two pins and, a correct angular orientation is assured by the engagement of the first member between the two pins.

2. A positioning feature as claimed in claim 1, wherein said first member defines two axially extending lateral faces each joining one end of the front face so that, a finer adjustment of the angular orientation of the stator assembly is provided by said two axially extending lateral faces contacting the two pins and therefore preventing further rotation of the stator assembly.

3. A positioning feature as claimed in claim 2 further comprising:

a second member arranged around the electrical leads and defining side axial faces so that, during the engagement process with the connector having the two pins extending aligned with the main axis, a correct angular orientation of the stator assembly is assured by the engagement of each of the two pins next to a respective one of said side axial faces.

4. A positioning feature as claimed in claim 3 wherein the second member defines two notches which engage the two pins when being correctly oriented, the side axial faces being faces of the two notches.

5. A positioning feature as claimed in claim 3, wherein the first member and the second member are integrally moulded together.

6. A positioning feature adapted to be arranged at the extremity of electrical leads of a stator assembly of a fuel injector, said extremity being provided with two terminals adapted to engage about a main axis in electrical contact with two pins of a connector, the positioning feature preventing incorrect positioning of the two terminals relative to the two pins, the positioning feature comprising:

a member arranged around the electrical leads and defining side axial faces so that, during the engagement process with the connector having the two pins, a correct angular orientation of the stator assembly is assured by the engagement of each of the two pins next to a respective one of said side axial faces.

7. Positioning feature as claimed in claim 6 wherein the member defines two notches which engage the two pins when being correctly oriented, the side axial faces being faces of the two notches.

8. A stator assembly of a fuel injector, said stator assembly comprising:

a solenoid and electrical leads overmoulded so that a cylindrical body is formed, from an end of which extend the electrical leads provided at their extremity with electrical terminals adapted to engage about a main axis in electrical contact with two pins of a connector, said two pins of said connector being separated from each other by an inter-pins distance, wherein a partition wall extends between said two terminals such that said terminals are symmetrically arranged on a first side of said partition wall and a second side of said partition wall respectively; and a positioning feature arranged beside the terminals, the positioning feature comprising:

a first member integral to the partition wall and laterally extending on said first side of said partition wall and on said second side of said partition wall, said partition wall and said first member having together a "T" cross-section where a vertical leg of the "T" is the partition wall and a horizontal bar of the "T" is the first member;

said first member having a transverse front face with a length extending perpendicular to the main axis which is smaller than the inter-pins distance of said two pins so that, during the engagement process with said connector having said two pins extending perpendicular to the main axis, an incorrect angular orientation of the stator assembly is prevented by a preliminary contact between the front face and one of the two pins and, a correct angular orientation is assured by the engagement of the first member between the two pins.

9. A stator assembly as claimed in claim 8, wherein said first member defines two axially extending lateral faces each joining one end of the front face so that, a finer adjustment of the angular orientation of the stator assembly is provided by said two axially extending lateral faces contacting the two pins and therefore preventing further rotation of the stator assembly.

10. A stator assembly as claimed in claim 9, wherein said positioning feature further comprises a second member arranged around the electrical leads and defining side axial faces so that, during the engagement process with the connector having the two pins extending aligned with the main axis, a correct angular orientation of the stator assembly is assured by the engagement of each of the two pins next to a respective one of said side axial faces.

11. A stator assembly as claimed in claim 10 wherein the second member defines two notches which engage the two pins when being correctly oriented, the side axial faces being faces of the two notches.

12. A stator assembly as claimed in claim 10, wherein the first member and the second member are integrally moulded together.

13. A stator assembly as claimed in claim 8 wherein the positioning feature is integrally moulded with the stator assembly.

14. A stator assembly as claimed in claim 13 wherein the terminals are sprung blades adapted to resiliently deflect when being forced in contact against the two pins of the connector, an accidental contact between said sprung terminals being prevented by an isolating partition wall overmoulded between the sprung terminals, said isolating partition wall being integral to the cylindrical body.

15. A stator assembly as claimed in claim 14, wherein said first member of the positioning feature is perpendicular to said isolating partition wall.

* * * * *